US005284464A

United States Patent [19]

Lee, III et al.

[11] Patent Number: 5,284,464

[45] Date of Patent: Feb. 8, 1994

[54] SWING TRAINING AND EXERCISING APPARATUS

[76] Inventors: George P. Lee, III, 640 Oak Ter., Norcross, Ga. 30071; David B. Leadbetter, 9606 Tavistock Rd., Orlando, Fla. 32827

[21] Appl. No.: 906,475

[22] Filed: Jun. 30, 1992

[51] Int. Cl.[5] ..... A63B 69/36

[52] U.S. Cl. ..... 482/121; 482/136; 482/51; 273/191 A

[58] Field of Search ..... 482/142, 133, 129, 121-123, 482/64, 52, 136; 273/69, 191 A, 191 B, 193 A, 193 B, 32.5, 33, 200 R, 201, 200 B, 189 R

[56] References Cited

U.S. PATENT DOCUMENTS

| | | | |
|---|---|---|---|
| 3,501,142 | 3/1970 | Johansson | 482/64 |
| 4,708,338 | 11/1987 | Potts | 482/52 |
| 5,050,874 | 9/1991 | Fitch | 482/136 |
| 5,125,882 | 6/1992 | La Mothe et al. | 482/114 |

FOREIGN PATENT DOCUMENTS

| | | | |
|---|---|---|---|
| 772222 | 10/1934 | France | 273/69 |
| 9108024 | 6/1991 | World Int. Prop. O. | 482/64 |

*Primary Examiner*—Richard J. Apley
*Assistant Examiner*—J. Donnelly
*Attorney, Agent, or Firm*—Aquilino & Welsh

[57] ABSTRACT

The golf swing training and exercising apparatus, including a base platform, upright housing and rotating parabolic arm connected between a simulated golf grip and a resistant source, which enables a golfer to execute a simulated golf swing by rotating the arm against the resistance. The structure includes a linkage which permits rotation of the arm in either the backswing or downswing direction, and against the resistance, enabling a golfer to exercise each group of muscles associated with the particular backswing and downswing movements, respectively.

6 Claims, 3 Drawing Sheets

SWING TRAINING AND EXERCISING APPARATUS

BACKGROUND AND SUMMARY OF THE INVENTION

The present invention relates to a golf swing training and muscle exercising apparatus which enables a user to simulate the movements of a proper swing and which also exercises the muscles of a golfer, making such a swing combined in a single apparatus.

The present invention is an improvement over U.S. Pat. No. 5,050,874, issued to Robert E. Fitch, and assigned to the same assignee as the present application. The disclosure of the 5,050,874 patent is incorporated in this application by way of reference.

In the patent, a golf swing training and exercising apparatus uses a rotating parabolic swing shaped arm connected between a golf grip and a resistance to enable the golfer to execute a simulated golf swing by rotating the swing arm against the resistance. The apparatus uses a rotating shaft connected between the swing arm and the resistance. Flexible cable is wound around a pulley which is connected to the rotatable shaft. This arrangement permits the parabolic arm to be swung only in one direction against the resistance, therefore enabling a golfer only to exercise the muscles used during the downswing portion of the golf swing.

The present invention presents an improvement over this swing training and exercising apparatus by permitting a golfer to use the apparatus in both the backswing mode and the downswing mode. This is accomplished by connecting the parabolic swing arm and rotating shaft to a sprocket member connected to a bicycle type chain which in turn is connected to a resistance spring. The sprocket structure permits the swing arm to be rotated in either direction, it being appreciated that the sprocket rotates either clockwise or counterclockwise, winding the chain with it upon the sprocket. The spring provides resistance in the same manner as the apparatus of U.S. Pat. No. 5,050,874.

It is therefore an object of the present invention to provide a new and improved golf swing training apparatus and combined exercising apparatus in which the muscles used in both the downswing portion and backswing portion of a golf swing may be trained. Other objects and advantages of the present invention will become apparent from the following drawings and description.

DESCRIPTION OF THE PREFERRED EMBODIMENTS

Figure 1:
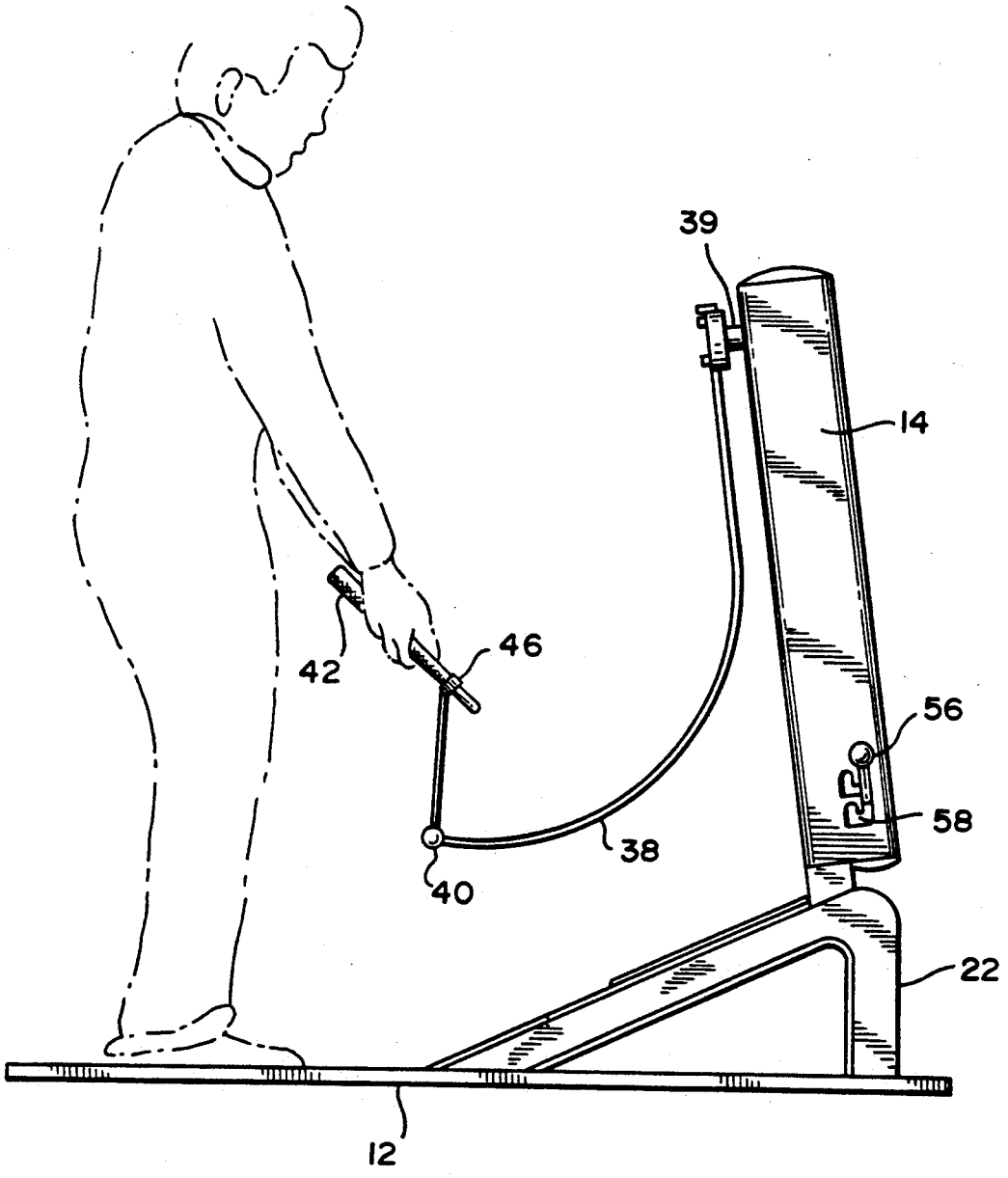
FIG. 1 shows a side elevational view of a golf swing training apparatus of the present invention.
Figure 2:
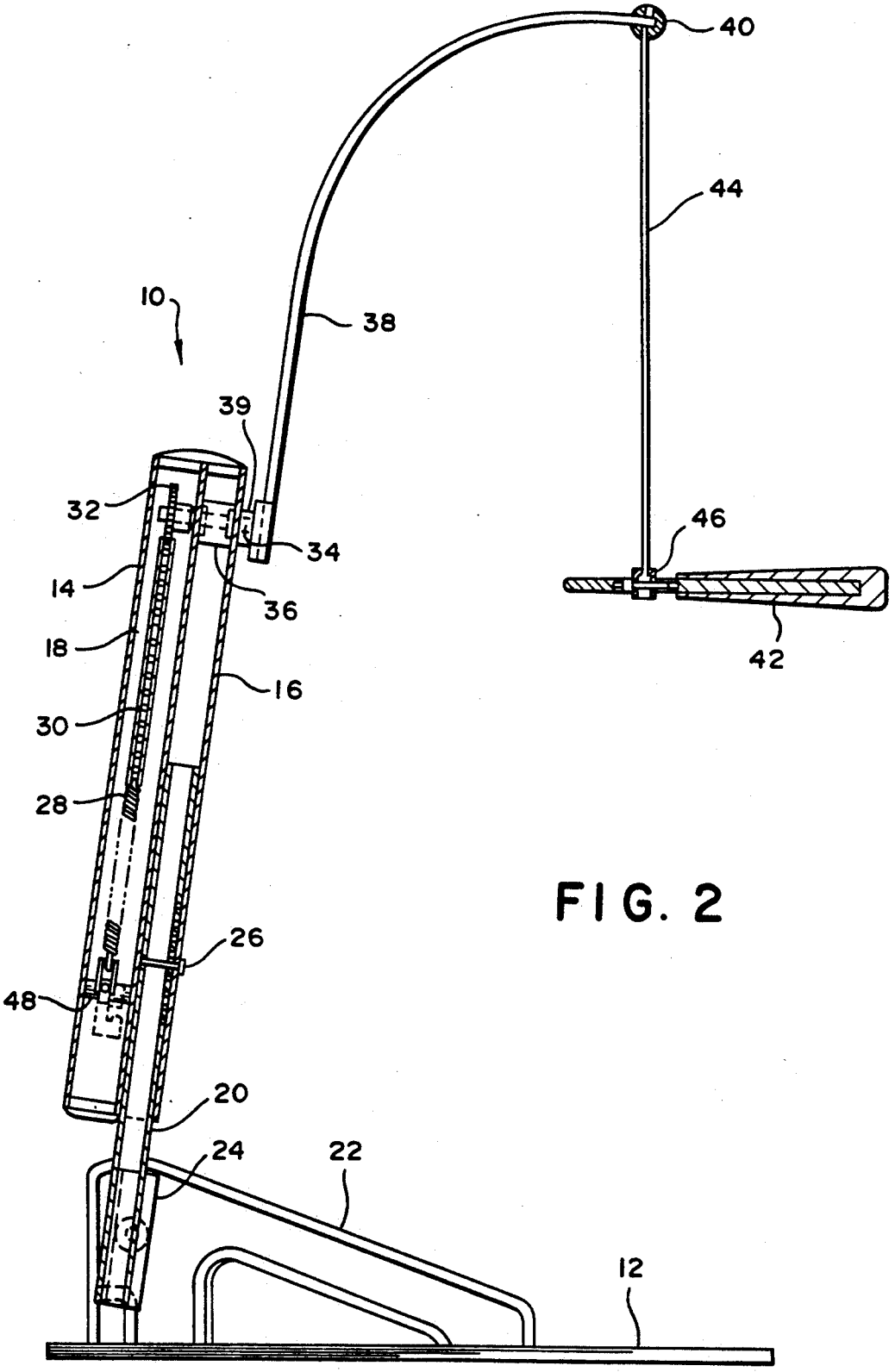
FIG. 2 is a side elevational view of the apparatus of FIG. 1, partly in section.

Referring to the drawings, the golf swing training and exercise apparatus 10 of the present invention is formed of a base platform 12 and an upright housing 14. The housing 14 is separated into two compartments 16 and 18. Compartment 16 acts as a female tubular support which cooperates with a male tubular support 20, which telescopically extends into the upper tubular support member 16. The lower tubular support member 20 is attached to a support bracket 22 secured to the base platform 12 and is angularly positioned thereon using an angle adapter plate 24, which may be adjusted between a nearly vertical position to a slightly angular position, as shown in the drawings. Preferably, the support bracket 22 is formed of a pair of angularly disposed legs, only one of which is shown, to support the upright housing 14 on the platform 12. The upper and lower tubular support members 16 and 20, respectively, are vertically positioned with respect to each other by telescopic movement between the two members to adjust the height of the apparatus to the height of the person using it. A pin 26 cooperates with a series of aligned bores (not shown) in order to fix the relative position of the tubular support members, once the overall height of the exercise apparatus is set. The tubular compartment 18 houses the resistance and drive assembly, including a spring 28, bicycle chain 30 and sprocket 32. The sprocket is fixed to a rotating shaft 34 mounted in a bearing 36, which in turn is rigidly fixed to a proximal end of a parabolic swing arm 38. A distal end 40 of the parabolic swing arm 38 connects a grip 42 to the end 40 of the parabolic swing arm 38 by means of a cable 44, and a suitable coupling 46. The parabolic swing arm 38 is connected to a hub 39 which is fixed to the shaft 34. It will be appreciated, with reference to U.S. Pat. No. 5,050,874, that rotation of the parabolic swing arm 38 by a golfer swinging the grip 42 to simulate a golf swing movement causes the parabolic swing arm 38 to rotate either clockwise or counterclockwise, depending upon whether a downswing or backswing movement is initiated.

The tension in the spring 28 can be regulated by movement of an adjustment bolt 48 to various ones of a series of adjustment positions. For example, moving the bolt 48 to the lowermost position provides increased tension in the spring, thereby requiring a greater force to move it with the parabolic swing arm. Similarly, by moving the adjustment bolt to the uppermost position, the tension in the spring is relaxed, thereby requiring less force through the rotation of the swing arm to displace the spring.

Referring to FIGS. 3, 4, 5 and 6, the sprocket and resistance assembly and its operation is shown in greater detail. The sprocket 32 is fixed to the shaft 34 and rotates therewith in either direction. A bicycle chain 30 is connected between the sprocket 32 and one end of the spring 28. The other end of the spring 38 is connected to the tension bolt 48, which is used to adjust the resistance.

Figure 3:
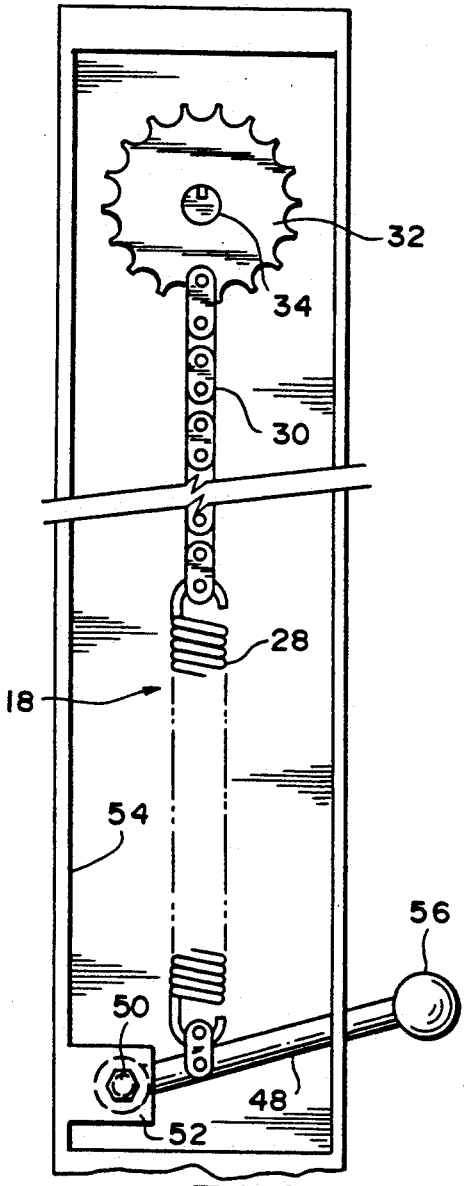
FIG. 3 shows a sectional view of a detail of the apparatus of claim 1.
Figure 6:
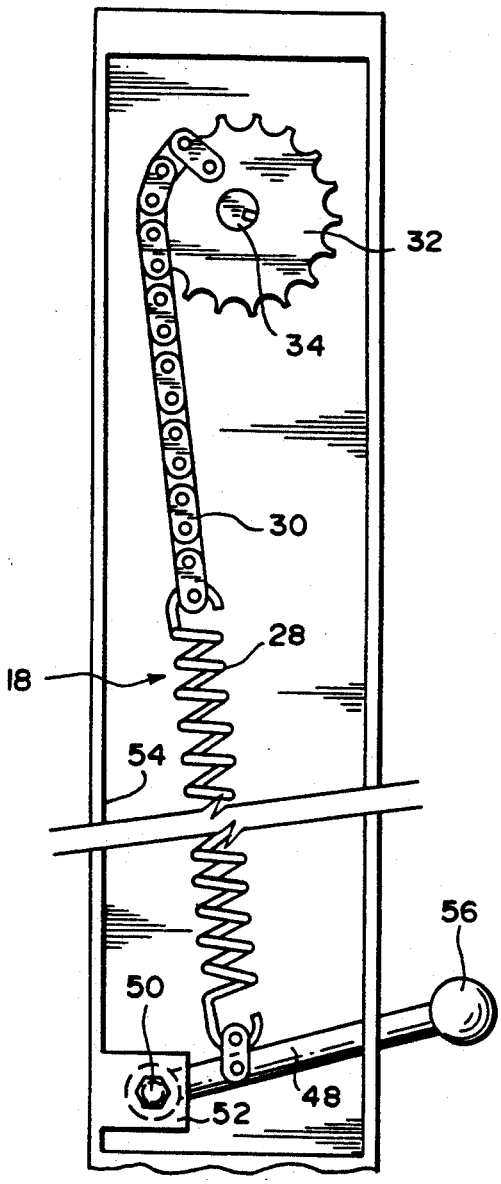
FIG. 6 shows another view of the apparatus of FIG. 3, with the linkage rotated in a different position.

FIG. 3 shows the position of the sprocket 32, chain 30 and spring 28 in a relaxed state without tension. FIG. 6 shows the position of the sprocket when it rotates with the shaft as the swing arm is moved by a golfer. In this position, the chain 30 winds around the sprocket 32 and the spring 28 is expanded, creating a resistance force. It will be appreciated that the chain 30 may be wound around the opposite side of the sprocket 32 when the spring arm 38 is rotated in the opposite direction, however, the spring 28 is placed under the same tension in either direction.

Figure 4:
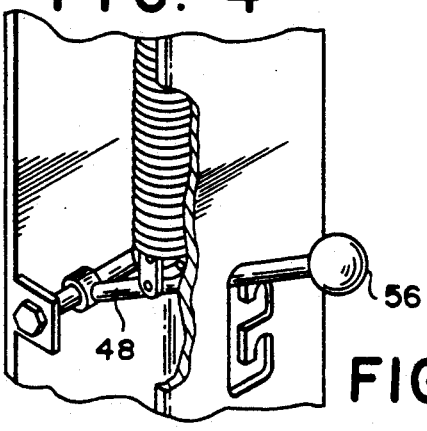
FIG. 4 shows a top view of the detail of FIG. 3.
Figure 5:
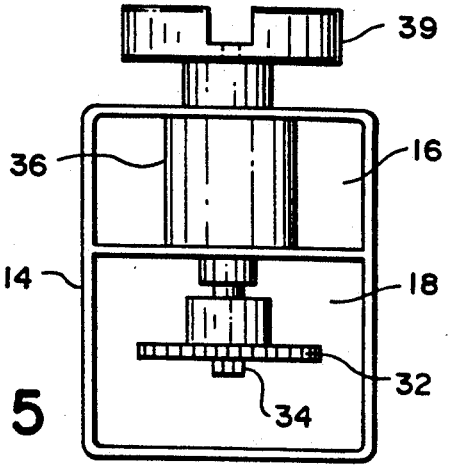
FIG. 5 shows a detailed view of FIG. 3.

The tension bolt 48 is connected to a pivot 50 formed in a bracket 52 attached to an inner wall 54 of the compartment 18. The opposite end of the tension bolt 48 extends through an opening in the housing 14 and includes an adjustment knob 56 is used to pivotably move the tension bolt 48 upwardly and downwardly to adjust the tension in the spring 28. A series of slots 58 are provided in the wall of the housing 14 to permit positioning of the tension bolt 48 in a variety of different tension positions. FIG. 4 shows a detailed view of the tension bolt 48 and how it is connected to the pivot 50, enabling the tension adjustments to be made.

Preferably, at least three tension settings are provided, although it will be appreciated that more or less may be used, depending upon the physical characteristics of the spring and various other factors, including the size and strength of the player or players which will use the apparatus.

It will be appreciated that the teeth of the sprocket 32 engage with and fit into openings in the chain 30 whereby rotation of the sprocket 32 in either direction will cause the chain 30 to wind around the sprocket to the extent of the rotation of the shaft 34. The shaft 34 is free to rotate in either direction, that is, it is rotatable by the user in either the downswing or backswing direction when the parabolic arm 38 is swung by a golfer. Rotation in either direction will cause the chain to expand the spring 28, thereby creating resistance which exercises the muscles of the user.

In use, and again with reference to U.S. Pat. No. 5,050,874, a player holds the grip and moves the parabolic arm in either the backswing or downswing direction in accordance with the specific exercise being performed. Rotation of the parabolic arm in turn rotates the shaft which rotates the sprocket 32 rigidly affixed thereto against the resistance of the spring to exercise the golf muscles of the golfer. It will be appreciated that the relative movement between all the parts is done with a minimum amount of friction, since the only thing that moves is the sprocket chain and spring.

It will also be appreciated that modifications may be made to the above-described invention in keeping within the scope of the appended claims.

We claim:

1. A golf swing training and exercise apparatus for simulating the proper swing path and for exercising the golf swing muscles, comprising:

a base for supporting a user;

a housing connected to the base and extending upwardly from the base;

a resistance means and a linkage means supported in said housing, the linkage means being operably connected to the resistance means;

a swing arm having a proximal end rotatably attached to said linkage means;

said linkage means being moveable in either a clockwise or counterclockwise direction against said resistance, thereby resisting the movement of said swing arm; said linkage means being formed of a sprocket rigidly attached to a rotatable shaft, said sprocket having a plurality of teeth formed around the peripheral edge thereof; said linkage means further including a chain operably connected to said sprocket, and arranged to the wound around said sprocket upon rotation in either a clockwise or a counterclockwise direction, said chain being connected to said resistance means whereby movement of aid chain around said sprocket expands said resistance, providing rotational resistance to the rotational movement of the shaft; and, grip means connected to a distal end of said swing arm whereby movement of the grip means in either a clockwise or counterclockwise direction, simulating a backswing or downswing movement by a golfer creates resistance to exercise the golf muscles of the golfer.

2. The apparatus of claim 1 wherein said resistance means is a spring.

3. The apparatus of claim 1 further including means to adjust the static resistance of the spring.

4. The apparatus of claim 1 wherein said adjustment means includes a pivotably mounted adjustment bolt structured to be positioned in a plurality of tension settings.

5. The apparatus of claim 1 wherein said swing arm is parabolic in shape.

6. A golf swing training and exercise apparatus for simulating the proper swing path and for exercising the golf swing muscles, comprising:

a base for supporting a user;

a housing proximate and extending upwardly relative to the base;

a resistance means and a linkage means supported in said housing, the linkage means being operably connected to the resistance means;

a swing arm having a proximal end rotatably attached to said linkage means;

said linkage means including a sprocket rigidly attached to a rotatable shaft and a chain operably connected to the sprocket and arranged to be wound around the sprocket upon rotation in either a clockwise or counterclockwise direction whereby movement of the chain and sprocket expands said resistance to resist the movement of the swing arm; and, grip means connected to a distal end of said swing arm whereby movement of the grip means and swing arm in either a clockwise or counterclockwise direction, simulating backswing or downswing motion of a golf swing, creates resistance to exercise the golf muscles of the golfer.

* * * * *